United States Patent [19]

Biancardi

[11] 4,227,588

[45] Oct. 14, 1980

[54] AUTOMATIC VEHICLE STARTING APPARATUS

[76] Inventor: Michael J. Biancardi, 88 Weeks Rd., N. Babylon, N.Y. 11703

[21] Appl. No.: 966,800

[22] Filed: Dec. 6, 1978

[51] Int. Cl.[3] ..... F02N 11/08

[52] U.S. Cl. ..... 180/167; 180/287; 290/38 E; 290/DIG. 3; 307/10 AT; 307/10 LS; 340/64

[58] Field of Search ..... 180/287, 289, 271, 167; 290/DIG. 3, 38 E, 38 C; 307/10 AT, 10 LS; 70/268, 269, 290; 340/63, 64

[56] References Cited

U.S. PATENT DOCUMENTS

| | | | |
|---|---|---|---|
| 2,544,955 | 3/1951 | Harrelson | 290/38 C |
| 3,553,472 | 1/1971 | Arlandson | 290/DIG. 3 |
| 3,685,606 | 8/1972 | Blow, Jr. | 180/114 |
| 3,696,333 | 10/1972 | Mott | 290/38 E X |
| 3,825,798 | 7/1974 | Teich | 307/10 LS X |
| 3,881,128 | 4/1975 | Douglas et al. | 307/10 LS X |
| 4,123,745 | 10/1978 | Gurgone | 340/63 |
| 4,131,304 | 12/1978 | Wagner | 290/38 C |
| 4,139,801 | 2/1979 | Linares | 307/10 LS X |

*Primary Examiner*—John J. Love
*Assistant Examiner*—D. W. Underwood
*Attorney, Agent, or Firm*—Richard L. Miller

[57] ABSTRACT

An apparatus which can automatically start and warm up a vehicle by means of a remote control signal. A remote control transmitter sends a signal of a predetermined frequency which is detected by a receiver located in the vehicle. The receiver produces an output signal in response to receiving the remote control signal which starts the operation of a starting circuit to provide an electrical energizing signal for operating the vehicle starter as well as a gas flow signal for sending a supply of gas to the vehicle carburetor. An operating circuit also starts which provides an electrical operating signal to the vehicle ignition system to continue the running of the vehicle once it is started. The operating circuit continues for a predetermined amount of time whereupon the car stops operating after it is sufficiently warmed up.

The apparatus also includes appropriate circuits for automatically operating various accessory electrical equipment in the vehicle such as the headlights, heater, air conditioner, defroster, etc. A protective circuit is included which automatically terminates the operation of the vehicle should the vehicle door be opened thereby preventing an unauthorized user to drive away.

21 Claims, 2 Drawing Figures

AUTOMATIC VEHICLE STARTING APPARATUS

BACKGROUND OF THE INVENTION

This invention relates to vehicle operating equipment, and more particularly to an apparatus for automatically starting and operating a vehicle by means of a remote control signal.

Vehicles, especially those utilizing internal combustion engines, should be warmed up before they are driven away. Warming up of the vehicle is of special importance during the cold weather where not only can the vehicle stall if it is improperly warmed up, but damage can be done to the motor if the engine is insufficiently warmed up. In many vehicles a period as long as five or ten minutes is required, especially in the cold weather, to sufficiently warm up the vehicle before normal use.

In most cases the driver does not allow himself sufficient time for warming up the vehicle prior to its use. Generally, the vehicles are first started in the morning when the driver is in a hurry and anxious to drive off. As a result, the vehicle life is frequently shortened because of such improper care and attention to warming up of the car.

In many situations, especially in the cold weather, it is inconvenient for the driver to sit in the cold vehicle while the vehicle warms up. In many cases, the driver will leave his house to start up the vehicle and then return back to his house leaving the vehicle unattended while it is warming up. This provides a great inconvenience to the driver, especially in cold weather, when he must completely dress himself and go out to the car just to start it and then return later to actually drive it off.

Additionally, not only in the morning when first starting out, but subsequently during the day, each time the driver returns to his vehicle, he should again allow time to warm it up. However, in most situations the driver does not provide ample opportunity for warming up the vehicle. As a result, not only is the vehicle damaged, but the driver himself is inconvenienced since as he initially drives off the vehicle will be cold and it will take some time until the car is warmed up enough to provide heat for the car.

The same situation occurs even during the warm weather where the car should still be warmed up before driving off. Also, with most cars equipped with airconditioning, when the driver first drives off, the car is extremely warm and it takes time until the air conditioner can cool off the interior of the car to provide comfort for the driver.

A similar problem occurs in connection with properly defrosting the windows. When frost or fog is present as a coating on the front and rear windows, it takes a considerable amount of time until the windows defrost. Normally the driver must wait in the vehicle until the car defroster operates sufficiently to clear the windows. This again delays the driver and provides an inconvenience during which time the driver must sit patiently and wait.

SUMMARY OF THE INVENTION

It is accordingly an object of the present invention to provide an apparatus which can automatically start and run a vehicle by means of a remote control signal.

A further object of the present invention is to provide an apparatus which includes a portable remote control transmitter for sending a signal which can serve to start and run a vehicle during a warm up period.

Yet a further object of the present invention is to provide an apparatus which includes a receiver built into the vehicle which can receive a remote control signal and in response thereto activate a starting circuit for starting the vehicle and an operating circuit for continued running of the vehicle during a preset amount of time.

An additional object of the present invention is to provide an apparatus which automatically starts a vehicle and permits it to run during a warm up period and which also activates various accessory electrical equipment in the vehicle such as the defroster, the heater, the air conditioner, the headlights, etc.

A further object of the present invention is to provide an apparatus which automatically starts and runs a vehicle during a warm up peroid and which provides a safety feature whereby as any of the vehicle doors is opened, the vehicle stops running to thereby prevent an authorized individual to ride off with the vehicle.

An additional feature of the present invention is to provide an apparatus for automatically starting and operating a vehicle which produces a start signal to start the vehicle and subsequently an operating signal to operate the vehicle and wherein the operating signal automatically disconnects the starting signal to prevent damage to the starter solenoid.

Yet, an additional object of the present invention is to provide an apparatus for automatically starting and operating a vehicle by means of a remote control signal which also activates the lighting system of the vehicle.

A further object of the present invention is to provide an apparatus for automatically starting and operating a vehicle which also automatically turns on the vehicle lights only when the ambient environment is dark.

A further object of the present invention is to provide an apparatus for automatically starting and operating a vehicle which also includes a control circuit for keeping "on" the headlights of the vehicle for a predetermined amount of time to permit the driver to return to his location.

Another object of the present invention is to provide an apparatus for automatically starting and operating a vehicle by means of a remote control signal, which is easy to operate, simple to install, and inexpensive to manufacture.

Another object of the present invention is to provide an apparatus connected to the lighting system of the vehicle which permits the driver to maintain the vehicle lights in an "on" condition after he leaves the vehicle, and the vehicle lights remain "on" for a predetermined amount of time, then automatically turn "off".

Briefly, in accordance with the present invention, there is provided an apparatus for automatically starting and operating a vehicle which includes a receiving means in the vehicle for receiving a remote signal and in response thereto producing an output signal for a first duration of time. A starting means also located in the vehicle receives the output signal from the receiving means and during the duration of the output signal provides an electrical energizing signal which operates the vehicle starter. It also produces a gas flow signal which sends a supply of gas to the vehicle carburetor. The vehicle can thereby start with these signals. At the same time there is also included an operating means in the vehicle which also responds to the starting means and produces an electrical operating signal to the vehicle ignition system for a second duration of time for continued running of the vehicle during that second duration of time.

In an embodiment of the invention, the receiving means is a receiver which responds to a transmitted signal of a preset frequency. The first duration of time corresponds to the presence of the transmitted signal. The transmitted signal can come from a portable remote transmitter with a control button whereby the transmitted signal is continued as long as the control button is depressed.

A feature of the invention is that upon opening of a door of the vehicle, the vehicle automatically stops operation to thereby prevent an unauthorized user of the vehicle from driving away.

The apparatus further includes equipment activating means which responds to the electrical operating signal from the operating means for activating at least some of the vehicle accessory electrical equipment, such as for example, the heater, the air conditioner, the defroster and the like.

There is also included a control for the vehicle lighting system which includes an ambient light detection circuit which permits activation of the vehicle lighting system only in a dark ambient environment. There can further be included a timing circuit which permits maintaining the vehicle lighting system turned on for a prefixed period of time to permit the driver to return to his premises after closing the vehicle. Also included is a protector circuit whereby the electrical energizing signal sent to the vehicle starter is automatically terminated once the vehicle is in a running condition.

The foregoing objects, features and advantages of the invention will, in part, be pointed out with particularity and will, in part, become obvious from the following more detailed description of the invention, taken in conjunction with the accompanying drawings which forms an integral part thereof.

BRIEF DESCRIPTION OF THE DRAWING

In the dawing.

DESCRIPTION OF THE PREFERRED EMBODIMENT

Figure 1:
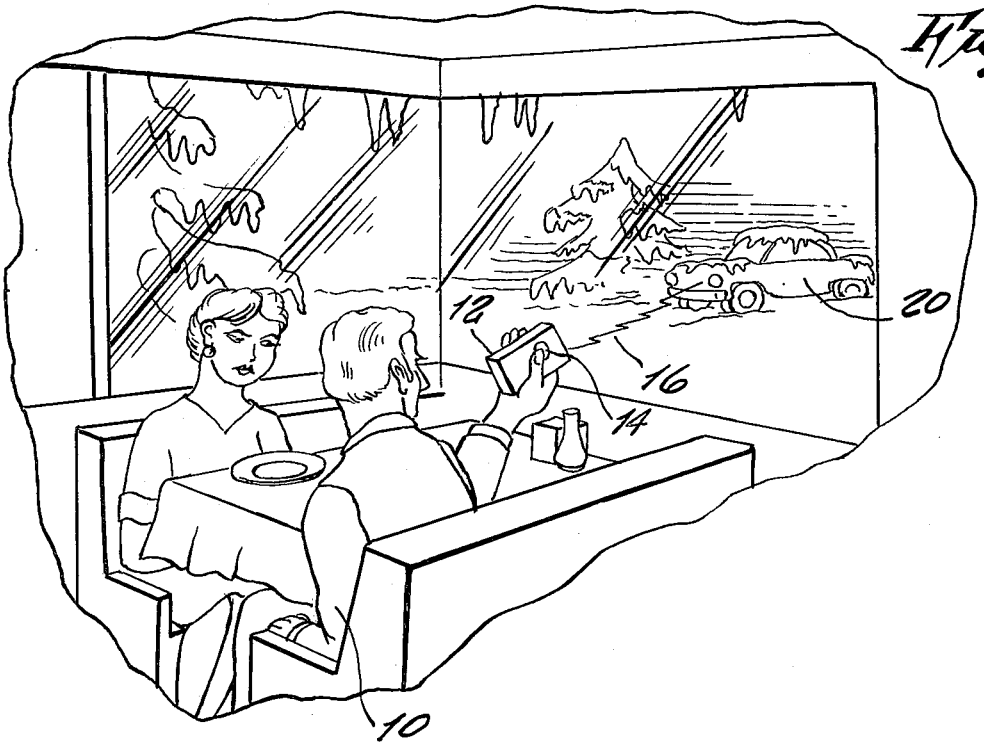
FIG. 1 schematically shows a typical scene whereby the driver of the vehicle is remotely starting and warming up his vehicle.

Referring now to FIG. 1, there is shown a typical scene wherein the present invention finds a useful application. By way of example, there is shown the driver of the vehicle 10 located within a building such as his home, a restaurant, etc., with his vehicle 20, located outside of the premises. It is evident from the drawing that it is during the winter and the car is in a cold condition. At the same time, the windows may be frozen with a layer of ice or frost, the interior of the car is probably cold, and, the lights of the car are turned off. Normally, in order to properly keep the car in its best working condition, the driver should leave the premises and go outside to warm up the vehicle. He can do this either by remaining in the vehicle during its warmup time or by starting the vehicle, insuring that it is going, and then returning inside the premises while the vehicle warms up by itself.

In either of the above situations there would be a tremendous inconvenience for the driver. He would first have to dress himself warmly to go outside to start the vehicle. If he remains inside the vehicle while it is warming up, the driver will be very cold and will have to waste a considerable amount of time. On the other hand if he should return to the inside of the building and let the vehicle warm up by itself, he risks the possiblity of having an unauthorized user drive away with the vehicle since it is already running. He also adds the inconvenience of having to go back and forth to put on and off the winter clothes.

As shown in FIG. 1, the driver of the vehicle is instead utilizing a portable remote control transitter 12, which contains a push button 14 and emits a signal having a predetermined frequency shown at 16. The signal can be such as to be transmitted for a predetermined duration of time. However, beneficially, the signal is continually transmitted as long as the button 14 is being depressed. A receiver located in the vehicle is capable of receiving the signal and in response thereto starts the vehicle and continues the running of the vehicle. The receiving device is such that it will start the vehicle with a starting signal sent to the vehicle starter solenoid and a gas flow signal for supplying a supply of gas to the vehicle carburetor. The operation of the starter solenoid will continue as long as the button 14 on the transmitter is depressed. In this manner, the user of the device can continue pressing the button 14 until he hears that the vehicle has started. In some cases it may take longer to start the vehicle depending upon its condition and the environmental temperature. However, since the starting is under control of the user, he can continually depress the button 14 until the vehicle has properly started. Then, he can release the button 14 and the vehicle will continue to run for a predetermined fixed amount of time whereupon it automatically turns off. By way of example, it can be set that the vehicle continues warming up for a period of 12 minutes and then turns off. This should provide sufficient time for the vehicle to warm up without damaging the vehicle. At the same time, even if the user does not come out to operate the vehicle during this time and delays considerably thereafter, the vehicle will not continue operating indefinitely but will only run for a sufficient amount of time needed to warm up the vehicle.

In many situations, the user of the device 12 will not be able to hear the vehicle and will not be able to know when the vehicle has already started. In that case he will not know when to remove his finger from the button 14. For that reason, the vehicle is equipped with automatic circuitry whereby once the vehicle starts running it prevents further signals from being sent to the starter solenoid. As a result, even if the user depressed the button 14 for an excessive amount of time, no damage will occur to the starting equipment of the vehicle. The vehicle will automatically start and once started will continue running for the predetermined amount of warm up time even though the user may excessively depress the button 14.

The equipment in the vehicle is designed so that in addition to starting and running the vehicle, it will operate various accessory electrical equipment, such as the defroster, the heater, the air conditioner, the lights, etc. The various devices can be preset as desired. For example, in the winter, the heater can be turned on so that it will automatically be operated by the vehicle. In the summer, on the other hand, the air conditioner can be preset in the vehicle so that the vehicle will operate the air conditioner during the warm up period and cool the interior of the vehicle to have it at a comfortable temperature for the driver when he is ready to operate the vehicle.

The equipment also includes an appropriate light detection circuit so that during the darkness hours the vehicle lights will be turned on during the warm up period while during daylight hours the vehicle lights will remain off. In this manner, during the warm up peroid at night time the vehicle lights will be turned on and it will prevent an unauthorized individual from approaching the vehicle even though the vehicle is unattended.

In order to prevent an unauthorized user from driving away with the vehicle, most vehicles include wheels that lock and prevent the steering wheel from turning without the insertion of the appropriate key. Therefore, even though the vehicle is running, an unauthorized user will not be able to turn the steering wheel without use of the appropriate ignition key. However, furthermore, the equipment can include a door interlock so that as soon as the door is opened the vehicle automatically stops running. When an unauthorized user opens the door, then of course, the vehicle should stop running to prevent him from driving away with the vehicle. At the same time, it is also appropriate that the vehicle should stop running when the driver himself approaches the vehicle. This will necessitate the driver's using the starter key to drive the vehicle in a conventional manner and avoid his thinking that the vehicle is properly operating when in fact it is only warming up with the automatic equipment of the present invention.

Figure 2:
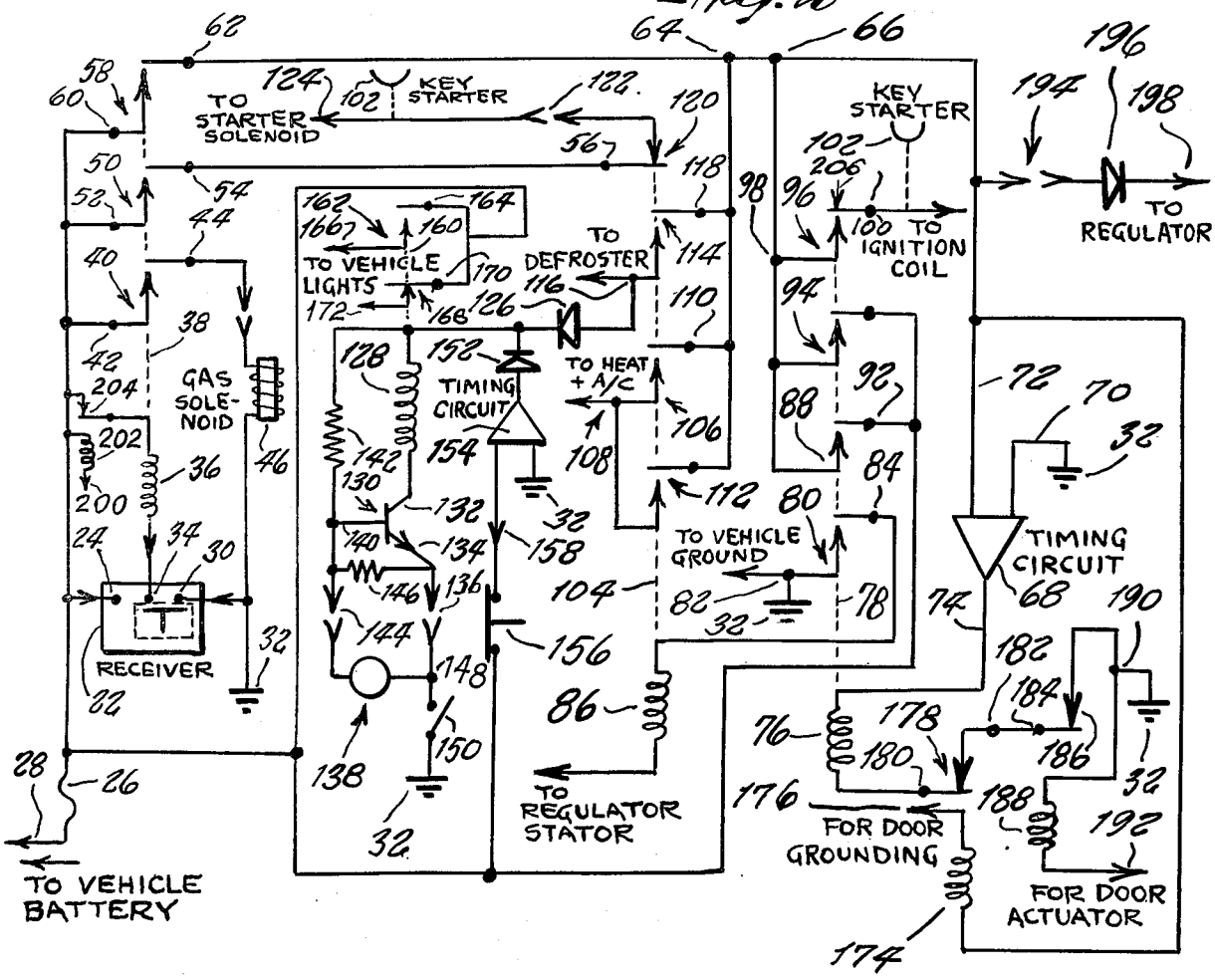
FIG. 2 is an electrical circuit showing the apparatus of the present invention.

Referring now to FIG. 2 there is shown a circuit diagram which embodies the foregoing features. The equipment shown in FIG. 2 would all be included on the vehicle and interconnected to various parts of the vehicle as will hereinafter be described. A receiver 22 is located in the vehicle and is capable of receiving a remote control signal as for example, the ratio frequency signal of the predetermined frequency. The receiver has one terminal 24 coupled by means of the fuse 26 to the terminal 28 which connects to the vehicle battery. The receiver includes another terminal 30 which is connected to the vehicle ground 32. An intermediate terminal 34 connects to a starting relay coil 36 whose other end is coupled to the terminal 28 to receive the vehicle battery current.

Three contact switches are controlled by means of the starting relay coil 36 as shown by means of the dotted lines 38. Specifically, a first contact switch 40 has one contact 42 interconnected to the vehicle battery terminal 28. The other contact 44 is available for connection to a gas solenoid 46 by means of a coupling 48. The other end of the gas solenoid 46 is connected to the vehicle ground 32. A second contact switch 50 has one contact terminal 52 connected to the vehicle battery 28 and its second contact terminal 54 connected to the contact terminal 56 of another contact switch, to be hereinafter described. A third contact switch 58 has one of its contact terminals 60 connected to the vehicle battery terminal 28 and its second contact terminal 62 connected to the terminal 64 to feed subsequent electrical eqiupment of the present invention.

The interconnecting contact 64 extends through the contact 66 and provides an input to a timing circuit 68, whose other input is grounded to the vehicle ground 32 by means of line 70. The timing circuit 68 can typically be the Archer timer RS555 sold by Radio Shack. This timing circuit operates so that upon initial application of a positive voltage at its input, it produces a positive voltage output pulse of a controlled time duration. The length of time is controlled by the value of an insertable capacitor placed in the timing circuit. Accordingly, upon applciation of a positive voltage input signal at the input on line 72, the timing circuit 68 will produce a positive output pulse on line 74 of a duration of time which can be controlled.

An operating relay coil 76 is connected to the output 74 of the timing circuit 68. The other end of the relay coil 76 is grounded as will hereinafter be explained.

A plurality of contact switches are operated by means of the operating relay coil 76, as shown by means of the dotted lines 78. Specifically, a first contact switch 80 has one of its contact terminals 82 connected to ground, and the other contact terminal 84 connected to a further relay coil 86, identified as an activating relay coil. A second contact switch 88 having one of its contact terminals interconnected to the connection point 66 and its other contact terminal 92 connected to the vehicle battery terminal 28. A third contact switch 94 is connected in parallel with the contact switch 88. A fourth contact switch 96 has its one contact terminal 98 connected to the connection point 66 and its other contact terminal 100 available for connection to the ignition coil in parallel with the normal key starter 102 provided on the vehicle and operated by means of the key ignition switch.

The activating relay coil 86 has one end connected to the regulator stator of the vehicle. As is well known, as the car operates the regulator stator gets a voltage across it corresponding to the value of the vehicle battery voltage. It is this terminal that is connected to the activating relay coil 86. The other end of the activating relay coil 86 is grounded through the contact switch 80, as heretofore described.

A plurality of contact switches are operated by means of the activating relay coil 86, as shown by means of the dotted lines 104. Specifically, contact switch 106 has one terminal 108 available for connection to various accessory electrical equipment on the vehicle such as the heater and the air conditioner. The other contact terminal 110 is interconnected to the connection point 64. The contact switch 112 is connected in parallel with the contact switch 106. The contact switch 114 has one terminal 116 available for connection to another accessory equipment, such as the defroster. Its other contact terminal 118 is connected to the connection point 64. A further contact switch 120 is arranged to be interconnected to the connection point 56. The other end of the contact switch 120 terminates in a coupling terminal 122 which interconnects to the starter solenoid at 124 in parallel with the key starter 102. This is the same key starter as heretofore described in connection with the ignition coil and is controlled by means of the operating key of the vehicle.

Interconnected to the contact terminal 116 of the contact switch 114, is also provided a lighting control circuit. A directional diode 126 permits flow in only a single direction into the lighting control relay coil 128. The other end of the lighting control relay coil 128 is connected to the circuit path of a transistor 130. Specifically, it is connected to the collector 132 of the transistor with the emitter 134 connected through the coupling device 136 to one side of a photodetection device 138, shown as a photocell. The base 140 of the transistor 130 is connected on the one hand to a resistor 142 and on the other hand through the coupling connector 144 to the other end of the photocell 138. A resistor 146 is connected between the base and the emitter of the transistor 130. One end of the photocell 138, specifically at point 148, is connected to the vehicle ground 32 by means of the manually operable, normally closed switch 150.

Connected in parallel with the light detection circuit is a timing control device. Specifically, a directional diode 152 is oppositely poled to the diode 126 and connected in parallel thereto. This diode 152 is placed in the output circuit of a timing circuit 154 having two inputs. One input is connected to the vehicle ground 32 and the other is connected to the vehicle battery terminal 28 by means of the normally closed, momentary opening contact switch 156 connected in the line 158.

The timing circuit 154 can be of a type similar to that of the timing circuit 68, heretofore described. Specifically, upon initial application of the input voltage on line 158, the output voltage from the timing circuit provides a positive voltage for a predetermined fixed amount of time, for example one and one half minutes. After that, the output of the timing circuit returns to zero even though there is a continued input to the timing circuit.

The lighting control relay coil 128 operates various contact switches. Such control is indicated by means of the dotted line 160. Specifically, a contact switch 162 has one of its contact terminals 164 interconnected to the vehicle battery terminal 28. The other contact terminal 166 is available for interconnection to the vehicle lights. Similarly, a second contact switch 168 has one of its contact terminals 170 also interconnected to the vehicle battery 28 and its other terminal available for connection also to part of the vehicle light at 172.

The reason for having the various contact switches is to permit use of the switch to control the headlights, the parking lights, as well as the light covers, and other parts of the lighting system as desired.

Referring back to the operating relay coil 76, it was mentioned before that one end thereof is grounded. Such grounding is achieved through a door interlock system. In all vehicles there is provided a lighting button in the door jamb whereby, as the vehicle doors open, the interior lights in the car will go on. In some vehicles this is achieved by grounding of the lights when the door is opened while in other vehicles it is achieved by interconnecting the lights to the vehicle battery when the door is opened. Accordingly, the door interlock circuit provides accommodation for either type of vehicle arrangement. Specifically, there is provided a first relay coil 174 having one end thereof connected to the vehicle battery terminal 28. The other end thereof 176 is available for connection to the door switch when the door is of the grounding type. The relay coil 174 controls a contact switch 178 having one terminal 180 connected to the operating relay coil 76 and the other terminal 182 connected to the contact terminal 184 of a contact switch 186, which will hereinafter be described.

A second relay coil 188 has one end thereof connected to the vehicle ground 32 by means of the terminal 190. The other end 192 is available for interconnection to the vehicle door for those vehicles which connect the door light switch to the vehicle battery terminal. The coil 188 operates the contact switch 186. One contact terminal is the terminal 184, as was described, and the other contact terminal is the terminal 190 connected to the vehicle ground 32.

There is optionally provided a contact plug 194 interconnected to the connection point 66 which can pass through the diode 196 and connect it to the regulator at 198. Some vehicles require application of a positive voltage to the regulator in order to operate the vehicle and for such type of vehicles this additional connection can be provided.

The operation of the aforedescribed circuit will now be explained. When the user wants to operate the device to start and run the vehicle during a warm up period, he sends out a signal with his remote transmitter. The receiver 22 accepts that signal and in response thereto interconnects the end of the starting relay coil 36 to the ground 32 as shown by the switch 200. The starting relay coil 36 is thereby energized. In doing so it closes the switches 40, 50 and 58. The closing of the switch 40 serves to energize the gas solenoid 46 to thereby send a pulse of gas to the carburetor. The gas solenoid can be connected to the carburetor in parallel with the acceleration pedal and serves to operate as a duplicate acceleration pedal to send a pulse of gas to the carburetor. The contact switch 50 serves to connect the vehicle battery voltage to the starter solenoid through the normally closed contact switch 120 to thereby start the solenoid operating to turn over the fly wheel of the vehicle. The contact switch 58 closes to send battery voltage to the operating part of the circuit which will continue the running of the vehicle.

The receiver will ground the starting coil 36 for as long a time as the transmitter sends out its signal. Thus, the user will keep the button depressed on his transmitter to keep the receiver in operation until the vehicle starts. He can thereby control the turning over of the flywheel during the starting operation until he actually hears the car start. At the same time, should the user keep his button depressed for too long a period of time he might damage the starter solenoid. For this reason, the switch 120 will open to disconnect the starter solenoid once the car is running, as will hereinafter be described.

By means of the contact switch 58, the timing circuit 68 will receive a positive voltage which will cause the output of the timing circuit to energize the operating relay coil 76 whose other end is grounded through the serially connected contact switches 178 and 186. Energizing of the operating coil 76 causes the contact switches 80, 88, 94 and 96 to close. Closing of the contact switches 88 and 94 permanently connects the vehicle battery voltage to the timing circuit 68. In this manner, even though the receiver will stop operating upon release of the transmitter button and thereby disconnect the battery voltage through the contact switch 58, nevertheless, the timing circuit will continue receiving an input voltage by means of the contact switches 88 and 94 which provide a self holding circuit for the operating relay coil 76.

The contact switch 96 will send the battery voltage to the ignition coil to properly provide the electrical signal to the spark plug thereby running the engine. It should be noted that initially the ignition coil will start to receive battery voltage through the switch 58 and then will continue to receive it by means of the self holding action provided by the switches 88 and 94. As a result, the ignition coil will start almost simultaneously with the starter solenoid whereby substantially simultaneously with the turning over of the fly wheel the ignition coil will start to fire the plugs. Subsequently, even though the starter solenoid coil is disconnected, the ignition coil continues to receive current.

The timing circuit 68 continues to provide an output voltage which continuously energizes the operating relay coil 76 for the predetermined time duration set with the timing circuit 68. By way of example, this can be set at twelve minutes. During that period of time, the car will continue operating. At the conclusion of that time, the output voltage from the timing circuit 68 will go back to zero which will serve to de-energize the operating relay coil 76 thereby disconnecting the vehicle battery voltage from the ignition coil and turning off the motor.

Upon energization of the operating relay coil 76, the contact switch 80 will also close to thereby ground the activating relay coil 86. The other end of the activating relay coil 86 is connected to the regulator stator. As the vehicle begins operating, the voltage on the regulator stator increases until it reaches the battery voltage. At that time, the activating relay coil 86 will become energized to control the operation of the switches 112, 106, 114 and 120.

By operating the switch 120, it opens the normally closed switch to thereby prevent any further current going to the starter solenoid. This is a safety feature whereby even though the user may depress the button on his transmitter for an extended period of time and the switch 58 will not open to prevent further current going to the starter solenoid, nevertheless, once the vehicle is properly running and the regulator reaches it full voltage, the switch 120 will open to thereby disconnect the starter. This will prevent the starter from being damaged during normal running operation of the vehicle.

The closing of the various switches 114, 106 and 112 will activate the various accessory electrical equipment in the vehicles such as the defroster, the heater, and/or the air conditioner. By utilizing the parallel connected switches 106,112, the extra current of the vehicle can be accommodated even though a conventional low value rated coil relay 86 is utilized. In a similar manner, utilizing the parallel combination of the switches 94 and 88, will permit utilization of a conventional relay coil 76 despite the high current provided.

Closing of the switch 114 also serves to energize the lighting control relay coil 128. However, the photocell 138 will serve as an override to insure that the lights only are turned on during the darkness hour. When the ambient light is dark, the photocell 138 provides a very high resistance, in the order to 5 megohms. This is placed in parallel with the high value resistor 146, of approximately 1 megohm. As a result, the transistor 130 will be turned on and the coil 128 will be grounded to thereby close the switches 162 and 168 to turn on the vehicle lights and other parts of the lighting system. On the contrary when there is sufficient ambient light, the photocell resistance will be low, as for example 100 ohms. The transistor 130 will then be turned off whereby the coil 128 will not be grounded and will therefore not be energized. The switches 162 and 168 will remain off which will prevent the lights from being turned on. The resistor 142 is typically approximately 22 K ohms. Utilization of the switch 150 permits manual override control of the lighting system whereby when the switch 150 is opened, the lights will not turn on at all, even during the darkness hours.

The timing circuit 154 provides an additional feature. Normally, there is a constant voltage input provided to the timing circuit. However, no output is provided until a new pulse of input voltage is provided. By momentarily opening the normally closed switch 156, this new pulse of input voltage is provided. At that point, an output will be provided from the timing circuit which will be sent to energize the lighting control relay coil 128. This will turn on the light, as long as the ambient light outside is dark, specifically during the night time hours. The timing circuit can be set at for example 1½ minutes. In this manner, before the driver leaves the vehicle, he can press the button 156. This will keep the lights on for approximately 1½ minutes to give him enough time to get him into the house. Thereafter the lights will automatically close by themselves This feature permits the driver the availability of having the lights on to give him enough light to get into the house. It also provides a safety feature since it will provide light when the driver goes into the house thereby tending to avoid any robberies or burglaries that might occur to the individual as he goes from the car to the house.

As heretofore mentioned, the operating relay coil 76 has one end thereof continuously grounded whereby it can be energized by means of the output voltage from the timing circuit 68. However, the door interlock circuit provides the feature that this relay will become de-energized should the door open. Normally, the coil 76 is connected to ground by means of the contact switches 178 and 186. Should the door be opened, one of these two contact switches will be opened. For those vehicles which have the door light switch button connected to ground, the relay 174 would be utilized. Upon opening of the door. the relay 174 would be grounded to thereby open the contact switch 178 thereby de-energizing the relay 76 and stopping the operation of the vehicle. For those vehicles having the door switch button connected to the positive battery voltage, the relay 188 would be utilized. Upon opening of the door, the end 192 is connected to the battery to energize the relay 188 thereby opening the switch 186 and again disconnecting the relay 176 from ground to de-energize it and stop the operation of the vehicle.

It should be appreciated therefore that the circuit as described provides automatic remote control for starting of a vehicle and running of the vehicle during a predetermined warm up period. After reaching that period, the vehicle automatically stops operating. At the same time, it provides an additional feature permitting the user to turn on the lights of the vehicle before he leaves the vehicle to give him sufficient light to return back to his premises.

An additional safety feature which can be incorporated in the circuit is relay coil 202. This has one end connected to the vehicle battery 28 while the other end 220 is connected to the key buzzer in such a matter that if the key is left in the ignition switch, 200 is held at ground potential.

Therefore contact set 204 would be held open and therefore interupped the starting of the system should the key be accidentally left in the car.

It should also be observed that there are several other ways in which the system can be connected to the vehicle so that it will automatically be shut down should an undesireable condition occur.

Terminal 192 and, or 176 can be connected either directly or through the appropriate set of blocking diodes to additional points such as the brake lights, hood light, and or trunk light so that the engine will be automatically shut down when the driver steps on the brake pedal or if someone tampers with the hood or trunk.

It should be additionally noted that if both of these two modifications are incorporated in the connecting of the system to the vehicle that the driver may enter the vehicle and drive away without restarting by simply turning ignition to on with his key.

An additional contact 206 can be used if a lock anti-theft device is to be incorporated with the system.

There has been described heretofore, the best embodiment of the invention presently contemplated. However, it is to be understood that various changes and modification may be made thereto without departing from the spirit of the invention.

I claim:

1. Apparatus for automatically starting and operating a vehicle comprising: receiving means for receiving a remote signal and in response thereto producing an output signal for a first duration of time; starting means receiving said output signal from said receiving means and during the duration of said output signal providing an electrical energizing signal for operating the vehicle starter and a gas flow signal for sending a supply of gas to the vehicle carburetor to thereby start the vehicle, and operating means responsive to said starting means for providing an electrical operating signal to the vehicle ignition system for a second duration of time for running the vehicle, wherein said operating means comprises a timing circuit triggered by said starting means and operative thereafter for a preset time period forming said second duration of time, an operating relay coil coupled to the output of said timing circuit for energization thereby from the vehicle battery during said second duration of time, at least three contact switches operated by said operating relay coil, one contact of one contact switch being adapted for connection to the vehicle battery, the other contact of said one contact switch being coupled to one contact of a second contact switch, and the other contact of the second contact switch being adapted for connection to the vehicle ignition coil, whereby upon triggering of said timing circuit, the vehicle ignition coil is interconnected to the vehicle battery for energization thereby during said second duration of time during which the vehicle will continue to operate.

2. Apparatus as in claim 1 wherein said receiving means comprises a receiver responsive to a transmitted signal of a preset frequency, said first duration of time corresponding to the presence of said transmitted signal.

3. Apparatus as in claim 2 wherein said starting means comprises a starting relay coil having three contact switches operated thereby, each contact switch having one contact thereof adapted for connection to the vehicle battery, the other contact of a first one of said contact switches being adapted for connection to the starter solenoid, the other contact of a second one of said contact switches being adapted for connection to a gas solenoid, the other contact of a third one of said contact switches being coupled to said operating means, and wherein said output signal from said receiving means energizes said starting relay coil from the vehicle battery to thereby close said three contact switches.

4. Apparatus as in claim 1, wherein one end of said operating relay coil is coupled to a door interlock circuit, whereby upon opening of a vehicle door said operating relay coil is de-energized thereby terminating operation of the vehicle.

5. Apparatus as in claim 4, wherein said door interlock circuit comprises a first relay coil having one end adapted for connection to the vehicle battery and the other end thereof available for connection to the door lighting button of vehicles which ground such button, a second relay coil having one end adapted for connection to the vehicle ground and the other end thereof available for connection to the door lighting button of vehicles which connect such button to the vehicle battery, first and second serially interconnected contact switches adapted for connection to the vehicle ground, said first and second contact switches being respectively operated by said first and second relay coils, said one end of said operating relay coil being coupled to said serially interconnected switches whereby energization of one of said first and second relay coils disconnects operating relay coil from ground to thereby de-energize it.

6. Apparatus for automatically starting and operating a vehicle, comprising:

receiving means for receiving a remote signal and in response thereto producing an output signal for a first duration of time;

starting means receiving said output signal from said receiving means and during the duration of said output signal providing an electrical energizing signal for operating the vehicle starter and a gas flow signal for sending a supply of gas to the vehicle carburetor to thereby start the vehicle;

operating means responsive to said starting means for providing an electrical operating signal to the vehicle ignition system for a second duration of time for running the vehicle, and equipment activating means responsive to the electrical operating signal from the operating means for activating at least some of the vehicle accessory electrical equipment, wherein said electrical activating means comprises an activating relay coil adapted for coupling to the vehicle regulator stator and being energized by said operating means, a plurality of contact switches operated by said activating relay coil, one contact of each of said contact switches being adapted for connection to the vehicle battery, the other contact of each of said contact switches being adapted for connection to a respective one of the vehicle accessory electrical equipment, including the heater, air conditioner, defroster, and the like.

7. Apparatus as in claim 6 wherein one of said contact switches is for activating the vehicle lighting system, and further comprising an ambient light detection circuit connected to said one contact switch and adapted for connection to the vehicle lighting system, said detection circuit operating to permit activation of the vehicle lighting system only in a dark ambient environment.

8. Apparatus as in claim 7 wherein said detection circuit comprises a photodetection device, a lighting relay coil having one end coupled to said one contact switch, transistor circuit means having its main circuit path interconnected between the other end of said lighting relay coil and the vehicle ground, and its control path coupled to said photodetection device, whereby a light ambient environment is detected by said photodetection device to thereby de-energize the lighting relay coil and a dark ambient environment is detected by said photodetection device to energize the lighting relay coil, and at least one lighting contact switch operated by said lighting relay coil, one contact thereof being adapted for connection to the vehicle light and the other contact thereof being adapted for connection to the vehicle battery.

9. Apparatus as in claim 8 and further comprising a manually operated override switch serially connected in said main circuit path for overriding operation of said ambient light detection circuit and deactivating the vehicle lighting system.

10. Apparatus as in claim 7 and further comprising a lighting timing circuit coupled to said ambient light detection circuit for manually activating the vehicle lighting system for a third duration of time.

11. Apparatus as in claim 10 wherein said lighting timing circuit comprises a timing circuit producing a voltage output for a prefixed period of time, constituting said third duration of time, upon initial receiving of a voltage input, the output of said timing circuit coupled to said ambient light detection circuit, the input of said timing circuit being adapted for connection to the vehicle battery, and a normally closed momentary operating switch serially connected to the input of said timing circuit.

12. Apparatus as in claim 6 and further comprising a protective contact switch operated by said activating relay coil and interconnected to said starting means to terminate the flow of said electrical energizing signal to the vehicle starter after the vehicle is running.

13. Apparatus as in claim 1 and further comprising means for connecting said electrical operating signal to the vehicle regulator to provide a positive voltage for operating the regulator.

14. Apparatus as in claim 1 wherein said operating means comprises relay coil means and a plurality of contact switch means operated by said relay coil means for activating parts of the vehicle, at least some of said contact switch means being connected in parallel with each other to thereby accommodate higher operating current with lower rated relay coil means.

15. Apparatus for automatically starting and operating a vehicle comprising: a remote transmitter for transmitting a signal of a predetermined frequency; a receiver located within the vehicle for receiving the signal transmitted and in response thereto producing an output; circuit means located within the vehicle, coupled to the vehicle battery and responsive to said output for starting and running the vehicle for a predetermined period of time, said circuit means further comprising starting means receiving said output signal from said receiving means and providing an electrical energizing signal for operating the vehicle starter and a gas flow signal for sending a supply of gas to the vehicle carburetor to thereby start the vehicle, and operating means responsive to said starting means for providing an electrical operating signal to the vehicle ignition system for a predetermined duration of time for running of the vehicle, and wherein said operating means comprises a timing circuit triggered by said starting means and operative thereafter for said predetermined period of time, an operating relay coil coupled to the output of said timing circuit for energization thereby from the vehicle battery during said predetermined period of time, at least two contact switches operated by said operating relay coil, one contact of one contact switch being connected to the vehicle battery, the other contact of said one contact switch being coupled to one contact of a second contact switch and the other of the second contact switch being connected to the vehicle ignition coil, whereby upon triggering of said timing circuit the vehicle ignition coil is interconnected to the vehicle battery for energization thereby during said predetermined period of time during which the vehicle will continue to operate.

16. Apparatus as in claim 15, wherein said starting means comprises a starting relay coil having three contact switches operated thereby, each contact switch having one contact thereof connected to the vehicle battery, the other contact of a first one of said contact switches being connected to the starter solenoid, the other contact of a second one of said contact switches being connected to a gas solenoid, the other contact of a third one said contact switches being coupled to said operating means, and wherein said output signal from said receiving means energizes said starting relay coil from the vehicle battery to thereby close said three contact switches.

17. Apparatus as in claim 15 wherein one end of said operating relay coil is coupled to a door interlock circuit whereby upon opening of a vehicle door said operating relay coil is de-energized thereby terminating operation of the vehicle.

18. Apparatus as in claim 15 and further comprising equipment activating means responsive to the electrical operating signal from the operating means for activing at least some of the vehicle accessory electrical equipment.

19. Apparatus as in claim 18 and further comprising light detection circuit means coupled to said equipment activating means for restricting activation of the vehicle lighting system to only a dark environment.

20. Apparatus as in claim 19 and further comprising a lighting timing circuit coupled to said light detection circuit means for manually activating the vehicle lighting system for a preset duration of time.

21. Apparatus as in claim 1 wherein said receiving means comprises a receiver responsive to a transmitted signal of a preset frequency, said first duration of time corresponding to the presence of said transmitted signal.

* * * * *